US005628552A

United States Patent [19]

O'Barr

[11] Patent Number: 5,628,552

[45] Date of Patent: May 13, 1997

[54] PORTABLE MULTI-COMPARTMENT DRAWER

[76] Inventor: Terry O'Barr, 4495 Madison SE., Grand Rapids, Mich. 49548-4367

[21] Appl. No.: 559,621

[22] Filed: Nov. 20, 1995

[51] Int. Cl.[6] ..... A47B 88/20

[52] U.S. Cl. ..... 312/330.1; 312/183; 312/204; 312/308; 312/211

[58] Field of Search ..... 312/298, 211, 312/330.1, 183, 348.3, 191, 237, 311, 308, 307, 244

[56] References Cited

U.S. PATENT DOCUMENTS

| | | | |
|---|---|---|---|
| D. 277,441 | 2/1985 | Handley | D6/510 |
| D. 278,254 | 4/1985 | Evenson | D19/75 |
| D. 278,664 | 5/1985 | Ferdinand et al. | D6/161 |
| D. 304,461 | 11/1989 | Foran et al. | D19/86 |
| D. 305,246 | 12/1989 | Kirchoff et al. | D19/75 |
| D. 305,247 | 12/1989 | Ukisu | D21/59 |
| D. 308,699 | 6/1990 | Ancona et al. | D19/75 |
| D. 309,981 | 8/1990 | French et al. | D3/74 |
| D. 323,532 | 1/1992 | Evenson | D19/75 |
| D. 330,219 | 10/1992 | Carlson et al. | D19/77 |
| D. 332,630 | 1/1993 | Brussing | D19/77 |
| D. 337,351 | 7/1993 | Chern | D19/75 |
| D. 348,692 | 7/1994 | Hou | D19/78 |
| D. 352,859 | 11/1994 | Kirchner et al. | D6/627 |
| D. 353,048 | 12/1994 | VanSkiver | D3/276 |
| 3,250,283 | 5/1966 | Reinfeld | 312/308 |
| 3,408,126 | 10/1968 | Mortensen | 312/183 |
| 3,883,205 | 5/1975 | Ambaum et al. | 312/330.1 |
| 3,890,024 | 6/1975 | Noneman et al. | 312/330 |
| 3,970,010 | 7/1976 | Cantley | 312/298 X |
| 4,010,989 | 3/1977 | Klug | 312/204 |
| 4,061,395 | 12/1977 | Boole | 297/92 |
| 4,124,261 | 11/1978 | Klaus | 312/183 |
| 4,163,559 | 8/1977 | Stenstrom | 273/148 A |
| 4,266,834 | 5/1981 | Ackeret | 312/183 X |
| 4,272,139 | 6/1981 | Fler | 312/334 |
| 4,283,097 | 8/1981 | Lundblad | 312/223 |
| 4,283,098 | 8/1981 | Sun | 312/319 |
| 4,479,684 | 10/1984 | Doyel | 312/330 R |
| 4,483,427 | 11/1984 | Gerch | 190/11 |
| 4,601,522 | 7/1986 | Rock | 384/19 |
| 4,616,892 | 10/1986 | Schleider | 312/330 R |
| 4,624,502 | 11/1986 | Boole | 297/192 |
| 4,632,472 | 12/1986 | Bross | 312/246 |
| 4,749,243 | 6/1988 | Rock et al. | 312/341 AR |
| 4,753,346 | 6/1988 | Tsuji | 206/371 |
| 4,766,292 | 8/1988 | Cone | 312/211 X |
| 4,785,971 | 11/1988 | Konarik | 312/183 X |
| 4,832,241 | 5/1989 | Radcliffe | 224/275 |
| 4,847,738 | 7/1989 | Nehl | 362/200 |
| 4,874,212 | 10/1989 | Rock et al. | 312/330.1 |
| 4,875,746 | 10/1989 | Rock et al. | 312/330 R |
| 4,923,261 | 5/1990 | Attardo | 312/313 |
| 4,949,484 | 8/1990 | Finger | 312/183 X |
| 5,013,106 | 5/1991 | Twellmann | 312/330 |
| 5,242,056 | 9/1993 | Zia et al. | 206/576 |
| 5,324,076 | 6/1994 | Nieradka | 281/45 |
| 5,382,009 | 1/1995 | Mertz et al. | 312/330.1 X |

*Primary Examiner*—Peter M. Cuomo
*Assistant Examiner*—Stephen Vu
*Attorney, Agent, or Firm*—Robert J. Sayfie

[57] ABSTRACT

A portable desk drawer that functions both as a conventional drawer and an attaché case. The portable desk drawer may be attached to various furniture pieces by a bracket which attaches to the glides, or the portable desk drawer may be used in conjunction with existing drawer glide assemblies. The portable desk drawer may easily be removed from the glides by a rotatably attached handle, and then carried by the user in the same manner as an attaché case. The portable desk drawer is comprised of a large front compartment and small rear compartments. A lid covers the large front compartments, and a tray, slidably housed inside the portable desk drawer, covers the small rear compartments during portage. The lid can be slid back and a portion of the lid can be flipped upwardly. The tray is further comprised of smaller compartments which are exposed when the tray lid is retracted. A clip on the interior of the lid of the portable desk drawer may be employed when the lid is open.

16 Claims, 4 Drawing Sheets

PORTABLE MULTI-COMPARTMENT DRAWER

BACKGROUND OF THE INVENTION

1. Field of the Invention

The present invention relates to a portable desk drawer. More particularly, the present invention relates to a portable desk drawer specifically adapted to function both as a conventional drawer and as a portable case, enabling the user to transport the same to various locations.

2. Description of the Related Art

For most people a desk drawer represents the location wherein countless important objects, materials, documents, and so forth are stored, placed, kept or otherwise hidden. Individuals spend an inordinate amount of time transporting various objects to and from their desk drawers to other places. Frequently one employs a briefcase, tote bag, knapsack, or other empty container to transport the desired objects and then unloads the same somewhere else. Sometime thereafter, those very same objects are brought back to the very same desk drawer. The numerous inconveniences stemming from the above situations has given rise for a need to simply an otherwise frustrating and time consuming task. What is needed therefore, is a device which functions as both a drawer and a briefcase, allowing for the storage of materials, objects, documents, and so forth and subsequent transport of the same to another location. Moreover, it would be necessary to have this device retrofitted to fit existing desks, and further have a handle to allow for easy transport of the device.

Numerous innovations for a portable desk drawer have been provided in the prior art that are described as follows. Even though these innovations may be suitable for the specific individual purposes to which they address, they differ from the present invention as hereinafter contrasted.

U.S. Pat. No. 5,013,106 to Twellmann discloses a plinth drawer designed to adapt to a variety of furniture. This patent differs from the present invention because this patent is not intended to be portable.

U.S. Pat. No. 4,923,261 to Attardo discloses a sliding drawer for storing and displaying cards. This patent differs from the present invention because this patent is not intended to be portable. Moreover, separate storage compartments are also not disclosed such as are disclosed in the portable desk drawer.

U.S. Pat. No. 4,875,746 to Rock et al. discloses a drawer assembly designed to guide a drawer in an out of a cabinet, desk or cabinet. This patent differs from the present invention because this patent is not intended to be portable desk drawer and is not comprised of separate storage compartments.

U.S. Pat. No. 4,847,738 to Nehl discloses a storage container with a drawer element intended to be used in vehicles. This patent differs from the present invention because this is a drawer comprised of separate storage compartments is not disclosed.

U.S. Pat. No. 4,061,395 to Boole discloses a portable drawer assembly to be used with a chair. This patent differs from the present invention because this patent is not intended to be portable but is rather to be used underneath a chair.

U.S. Pat. No. 4,749,243 to Rock et al discloses a drawer with improved pull-out rail, drawer frame and rail slide. This patent differs from the present invention because this patent is not intended to be portable.

U.S. Pat. No. 4,632,472 to Bross discloses an under hanging drawer system designed to be used under shelves, cupboards, cabinets and so forth. This patent differs from the present invention because this patent is not intended to be portable.

U.S. Pat. No. 5,013,106 to Twellmann discloses a plinth drawer designed to adapt to a variety of furniture. This patent differs from the present invention because this patent is not intended to be portable.

U.S. Pat. No. 4,624,502 to Boole discloses a portable drawer assembly to be used with a chair. This patent differs from the present invention because this patent is not intended to be portable but is rather to be used underneath a chair.

U.S. Pat. No. 4,616,892 to Schleicher discloses a plastic drawer. This patent differs from the present invention because this patent is not intended to be portable.

U.S. Pat. No. 4,601,522 to Pock discloses a pull-out guide assembly for drawers. This patent differs from the present invention because this patent is not intended to be a portable drawer.

U.S. Pat. No. 4,479,684 to Doyle discloses a nesting drawer assembly. This patent differs from the present invention because this patent is not intended to be portable.

U.S. Pat. No. 4,283,098 to Sun discloses an attaché case having a drawer apparatus. This patent differs from the present invention because a portable drawer with separate compartments is not disclosed. Moreover, an enclosed sliding tray retractably housed within the drawer is not disclosed.

U.S. Pat. No. 4,272,139 to Fler discloses a sliding drawer suspension. This patent differs from the present invention because a portable desk drawer is not disclosed.

U.S. Pat. No. 4,163,559 to Stenstrom discloses a compartmented card game box with removable drawer. This patent differs from the present invention because a portable desk drawer is not disclosed.

U.S. Pat. No. 4,010,989 to Klug discloses a lockable drawer compartment. This patent differs from the present invention because a portable desk drawer is not disclosed.

U.S. Pat. No. 3,890,024 to Noneman et al. discloses a molded plastic drawer. This patent differs from the present invention because a portable desk drawer is not disclosed.

U.S. Pat. No. 352,859 to Kirchnet et al. discloses a drawer case for computer diskette storage. This patent differs from the present invention because a portable desk drawer with individualized compartments is not disclosed.

U.S. Pat. No. 308,699 to Ancona et al. discloses an accessory drawer for use in a mail room. This patent differs from the present invention because a portable desk drawer is not disclosed.

U.S. Pat. No. 278,664 to Ferdinand et al. discloses a drawer. This patent differs from the present invention because a portable desk drawer is not disclosed.

U.S. Pat. No. 277,441 to Handley discloses a storage drawer for hair care implements. This patent differs from the present invention because a portable desk drawer is not disclosed.

U.S. Pat. No. 4,483,427 to Gerch discloses a combination attaché case and traveling case. This patent differs from the present invention because a portable desk drawer is not disclosed.

U.S. Pat. No. 4,061,395 to Boole discloses a portable drawer assembly for use underneath chairs. This patent differs from the present invention because a portable desk drawer is not disclosed.

U.S. Pat. No. 5,324,076 to Nieradka discloses a clip board with storage drawer. This patent differs from the present invention because a portable desk drawer is not disclosed.

U.S. Pat. No. 4,832,241 to Radcliffe discloses a vehicle portable office organizer. This patent differs from the present invention because a portable desk drawer is not disclosed.

U.S. Pat. No. 5,242,056 to Zia et al. disclosed a portable office. This patent differs from the present invention because a portable desk drawer is not disclosed.

U.S. Pat. No. 4,283,097 to Lundblad discloses a cassette for handling banknotes. This patent differs from the present invention because a portable desk drawer is not disclosed.

U.S. Pat. No. 353,048 to VanSkiver et al. discloses a storage case. This patent differs from the present invention because a portable desk drawer is not disclosed.

U.S. Pat. No. 309,981 to French et al. discloses a storage case. This patent differs from the present invention because a portable desk drawer is not disclosed.

U.S. Pat. No. 4,753,346 to Tsuji discloses an automobile shaped case for desk accessories. This patent differs from the present invention because a portable desk drawer is not disclosed.

U.S. Pat. No. 323,532 to Evenson discloses a drawer organizer. This patent differs from the present invention because a portable desk drawer is not disclosed.

U.S. Pat. No. 305,246 to Kirchhoff et al. discloses a desk organizer. This patent differs from the present invention because a portable desk drawer is not disclosed.

U.S. Pat. No. 348,692 to Hou discloses a desk organizer. This patent differs from the present invention because a portable desk drawer is not disclosed.

U.S. Pat. No. 337,351 to Chern discloses an organizer for assorted desk articles. This patent differs from the present invention because a portable desk drawer is not disclosed.

U.S. Pat. No. 304,461 to Foran et al. discloses a compartmented file box. This patent differs from the present invention because a portable desk drawer is not disclosed.

U.S. Pat. No. 330,219 to Carlson et al. discloses an adjustable desk organizer. This parent differs from the present invention because a portable desk drawer is not disclosed.

U.S. Pat. No. 278,254 to Evenson discloses a sliding drawer insert for a desk storage tray system. This patent differs from the present invention because a portable desk drawer is not disclosed.

U.S. Pat. No. 332,630 to Brussing discloses a desk accessory holder. This patent differs from the present invention because a portable desk drawer is not disclosed.

U.S. Pat. No. 305,247 to Ukisu discloses a simulative toy box. This patent differs from the present invention because a portable desk drawer is not disclosed.

Numerous innovations for a portable desk drawer have been provided in the prior art that are adapted to be used. Even though these innovations may be suitable for the specific individual purposes to which they address, they would not be suitable for the purposes of the present invention as heretofore described.

SUMMARY OF THE INVENTION

In accordance with the present invention, a portable desk drawer is comprised of a conventional four-sided drawer with a plurality of individual compartments contained therein. The portable desk drawer is further comprised of runners, braces and stoppers that enable the device to be mounted onto desks, cabinets, dressers and so forth. Further, the portable desk drawer has a locking lid and handle that allows the device to be locked and the items therein to be secured within the individual compartments. Moreover, the handle of the portable desk drawer allow for the easy transport of the device.

Accordingly, it is an object of the present invention to provide a portable desk drawer.

More particularly, it is an object of the present invention to provide a portable desk drawer specifically adapted to enable is user to easily, conveniently and efficiently transport essential materials, documents and related objects from a desk to another desired location.

In keeping With these objects, and with others which will become apparent hereinafter, one feature of the present invention resides, briefly stated, in that the portable desk drawer permits the user a convenient method of transporting paperwork, materials, documents and related objects to and from a desk, cabinet, dresser and so forth.

When the portable desk drawer is designed in accordance with the present invention, it provides the user with a convenient means to store paperwork, stationary, pens, paper, computer disks and related material.

Another feature of the present invention is versatile construction, enabling the portable desk drawer to be manufactured in a variety lengths and widths to accommodate the various demands of the individual.

Another feature of the present invention is that it is simple to use, requiring the user to merely pull the portable desk drawer from its particular storage area and carry the same by the built-in handle.

Yet another feature of the present invention is that is its versatile adaptability, enabling the portable desk drawer to be used in connection with a variety of existing desks, cabinets and so forth.

Still another feature of the present invention is that it may be manufactured from a number of different materials including, but not limited to: wood, metal, metal alloy, plastic, plastic composite and fiberglass.

Still yet another feature of the present invention is the simplicity of design, which would facilitate the manufacture and production of the portable desk drawer.

Yet another feature of the present invention is that the portable desk drawer is comprised of numerous individual compartments to allow for the storage of objects, materials, documents and so forth of varying sizes.

Still another feature of the present invention is that the portable desk drawer has a locking lid which when closed seals the individual compartments preventing the objects stored therein from escaping during portage.

Yet still another feature of the present invention is that the lid is manufactured also as a separate storage compartment for small articles such as pens, pencils, batteries and so forth.

Another feature of the present invention is that a built-in handle allows for convenient transport of the device.

Another feature of the present invention is that a built-in clip attached to the inside of the lid holds pads, papers and other articles.

Yet still another feature of the present invention is that the device is also comprised of a mounting bracket assembly enabling the portable desk drawer to be mounted to various pieces of furniture.

Still yet another feature of the present invention is that the portable device has a lid which can be slidably mounted on the top of the portable desk drawer, which lid may be slid backwardly or flipped upwardly.

The novel features which are considered characteristic for the invention are set forth in the appended claims. The invention itself, however, both as to its construction and is method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—portable desk drawer 10

12—handle 12

14—drawer insert 14

14A—drawer insert compartment 14A

16—lid 16

16A—lid lock 16A

16B—lid clip 16B

16C—lid hinges 16C

16D—lid tabs 16D

18—bracket 18

20—glides 20

22—frame 22

24—tray 24

24A—tray glides 24A

24B—tray stop 24B

24C—tray lid 24C

24D—tray compartments 24D

26—front compartment 26

28—desk 28

BRIEF DESCRIPTION OF THE PREFERRED EMBODIMENT

Figures 7, 7A, 7B:
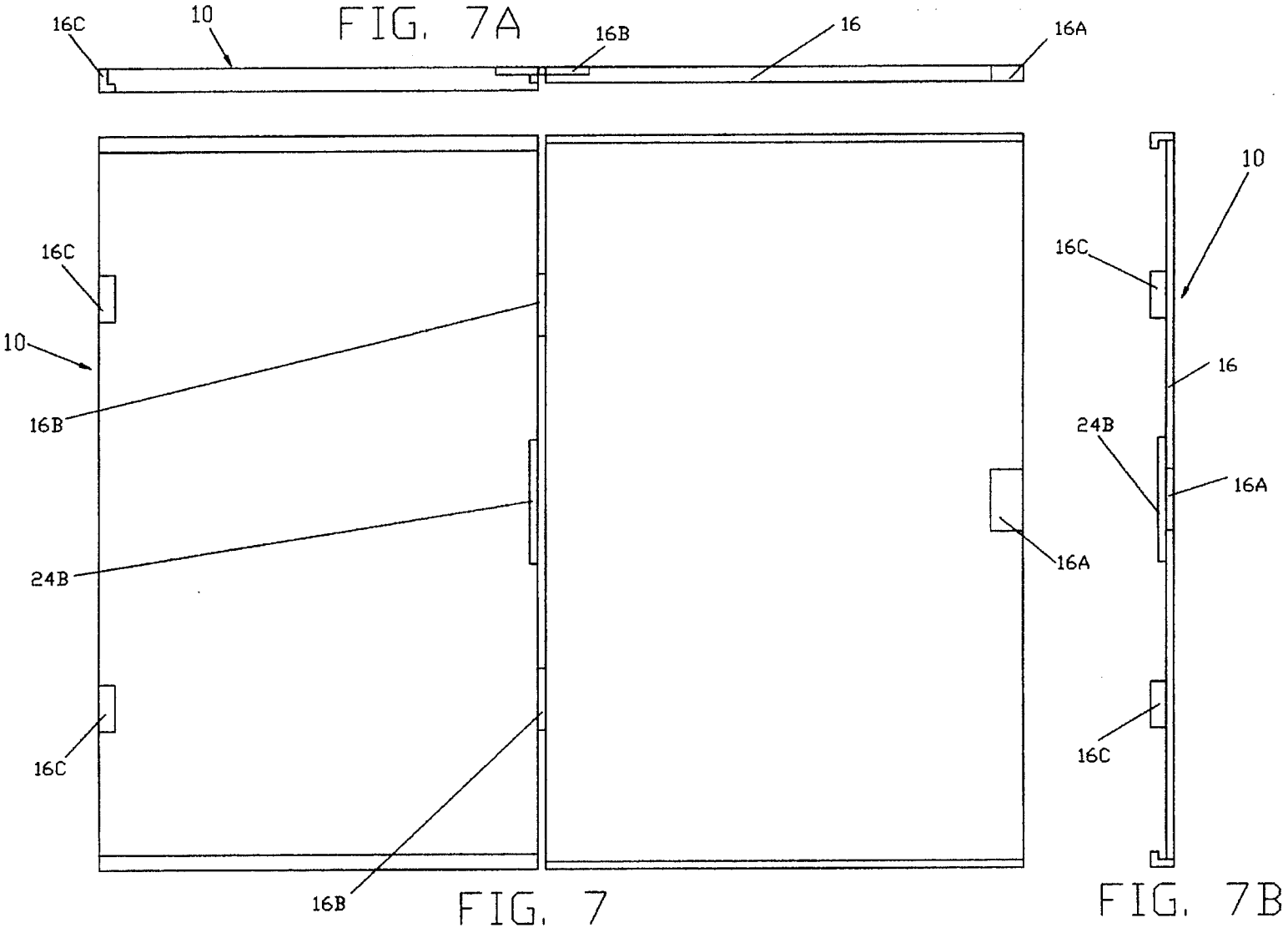
FIG. 7 is a bottom view of the slidable and flippable lid.

FIG. 7*a* is a side view of the lid; and

FIG. 7*b* is a side view of the lid.

DETAILED DESCRIPTION OF THE PREFERRED EMBODIMENT

Figure 1:
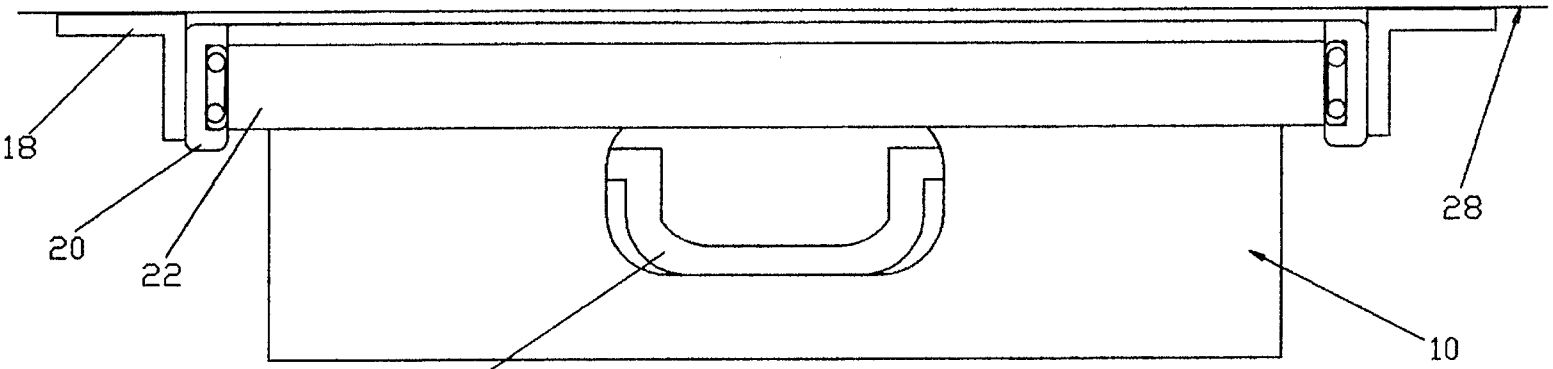
FIG. 1 is a front view of the portable desk drawer housed in bracket.

Firstly, referring to FIG. 1 which is a front view of the portable desk drawer 10 exhibiting the following features: handle 12; drawer insert 14; drawer insert compartment 14A; lid 16; lid lock 16A; lid clip 16B; bracket 18; glides 20; frame 22; tray 24; tray glides 24A; tray stop 24B; tray lid 24C; tray compartments 24D; front compartment 26; and desk 28. A handle 12 is rotatably attached to the front of the portable desk drawer 10 allowing the portable desk drawer 10 to be pulled in and out of a desk 28 or similar furniture piece. The handle 12 also allows an individual to carry the portable desk drawer 10 once the same has been removed from the desk 28 or other furniture piece. The portable desk drawer 10 is manufactured from a group of materials consisting of wood, metal, metal alloy, plastic, plastic composite, epoxy and fiberglass. Two glides 20, one on either side of the portable desk drawer 10, allow the portable desk drawer 10 to slide forwards and backwards by means of a frame 22 secured around the top of the portable desk drawer 10. The frame 22 extends outward from the top of the portable desk drawer 10, enabling the same to slide smoothly and easily between the glides 20. A bracket 18 attaches to the glides 20 on one end, the other end of the bracket 18, which extends outwardly, is secured to a desk 28 or other furniture piece. The bracket 18 may be secured to a variety of furniture pieces including a desk 28, chair, cabinet, shelf, counter, bookcase, table, stand, and workbench. The portable desk drawer 10 may be manufactured in a variety of lengths and widths to accommodate a variety of different furniture pieces in an endless variety of sizes. Moreover, the portable desk drawer 10 is also constructed to fit existing glide assemblies, enabling the device to be used with existing drawer systems.

Figure 2:
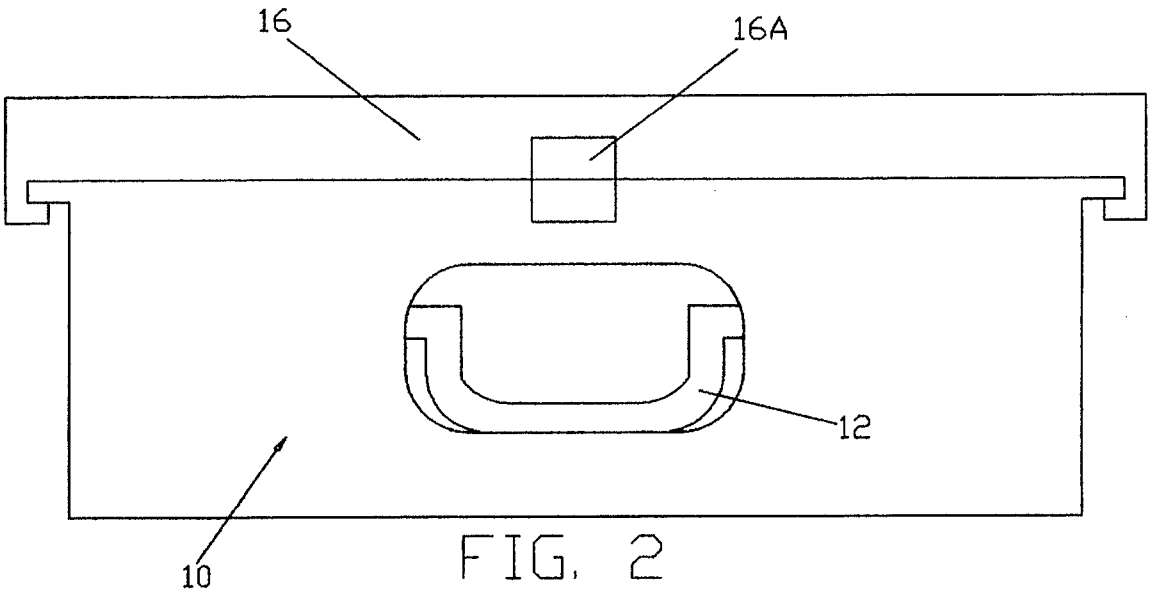
FIG. 2 is a front view of the portable desk drawer removed from bracket.

Referring to FIG. 2 which is a front view of the portable desk drawer 10 removed from the glide assembly. A lid 16 covers the top of the portable desk drawer 10 and may be secured thereto be means of a lid lock 16A. The lid lock 16A prevents the lid 16 from opening when the portable desk drawer 10 is being carried. In addition, a lid clip 16B is affixed to the bottom of the lid 16. When the lid 16 is opened, the lid clip 16B is exposed. The lid clip 16B is designed to allow the user to secure note pads, papers and related matter for easy accessibility. The portable desk drawer 10 functions as conventional desk drawer when the same is placed in the desk 28 or other furniture pieces. The portable desk drawer 10 also functions as a brief case, attaché case or similar device when the same is removed from the desk 28 or other furniture piece. Materials such as pens, pencils, paper, documents, personal effects, office supplies and so forth are held in place during portage by means of the lid 16 which is secured to the portable desk drawer by the lid lock 16A.

Figure 3:
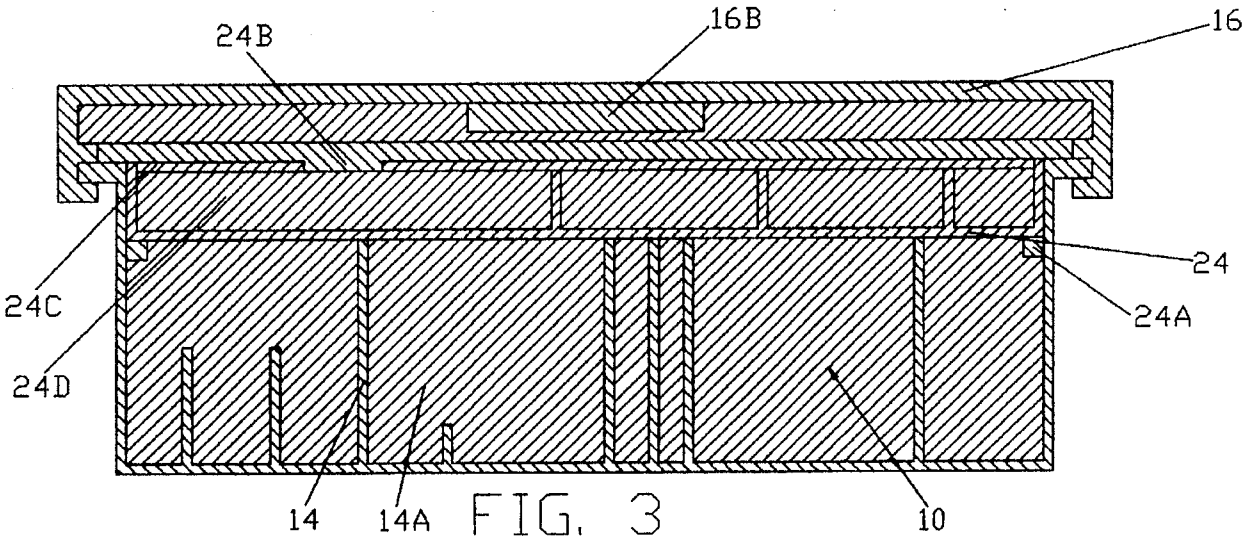
FIG. 3 is a front cross-section view of the portable desk drawer.

Referring to FIG. 3 which is a front cross sectional view of the portable desk drawer 10 exhibiting the rear drawer inserts 14 which are located toward the back portion of the portable desk drawer 10. The drawer insert 14 is a plurality of drawer inserts 14 which extend upwardly from the bottom for the portable desk drawer 10. The plurality of drawer inserts 14 are manufactured in varying lengths. The plurality of drawer inserts 14 form a drawer insert compartment 14A. The drawer insert compartment 14A is preferably a plurality of drawer insert compartments 14A wherein numerous items such as pens, pencils, paper, documents, personal effects, office supplies and so forth are stored. The portable desk drawer 10 is manufactured with different pluralities of drawer inserts 14 forming different pluralities of draw insert compartments 14A. In addition, the plurality of drawer inserts 14 are manufactured with varying lengths and are spaced at varying distances from one another, in order to accommodate the particular needs of each user. A tray 24, slidably contained in the rear of the portable desk drawer 10, covers the separate compartments created by the rear drawer inserts 14. The tray 24 is comprised of tray compartments 24D which are intended to store small objects such as thumb tacks, paper clips, pins and so forth. The tray 24 has a tray lid 24C which coves the tray compartments 24D. The tray 24 is able to slide from the rear of the portable desk drawer 10 to the front of the same by means of tray glide 24A located on toward the front of the portable desk drawer 10. The tray 24 is prevented from escaping the portable desk drawer 10 by means of a tray stop 24B located on the front of the portable desk drawer. The tray 24 is slid forward to expose the contents stored within the plurality of drawer insert compartments 14A. The tray 24 is returned to is original position in the rear of the portable desk drawer 10 to prevent the contents from escaping when the portable desk drawer 10 is being carried. The tray 24 is then held in place by means of the tray stop 24B.

Figure 4:
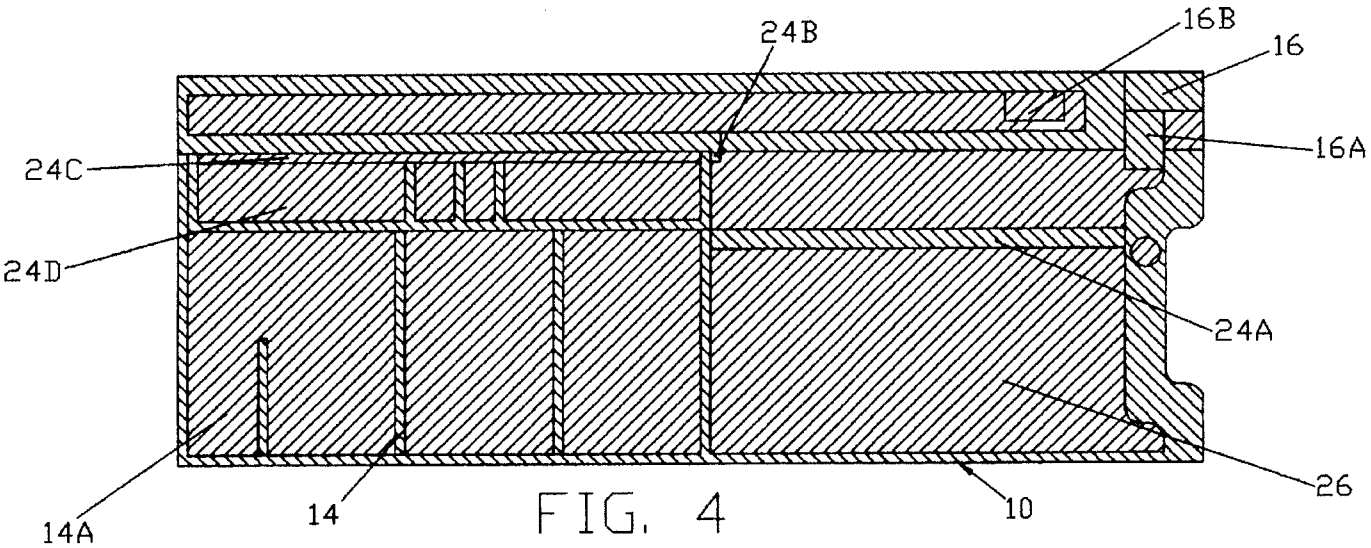
FIG. 4 is a side cross-section view of the portable desk drawer.

Referring to FIG. 4 which is a side cross section view of the portable desk drawer 10 exhibiting a front compartment 26 which occupies the front portion of the portable desk drawer 10. The front compartment 26 is intended to store larger items which are unable to be conveniently stored within the rear compartments. Items such as a clock, stapler, tape dispenser, computer discs and so forth may be stored within the front compartment 26. When the lid 16 is closed, the contents of the front compartment 26 are secured therein.

Figure 5:
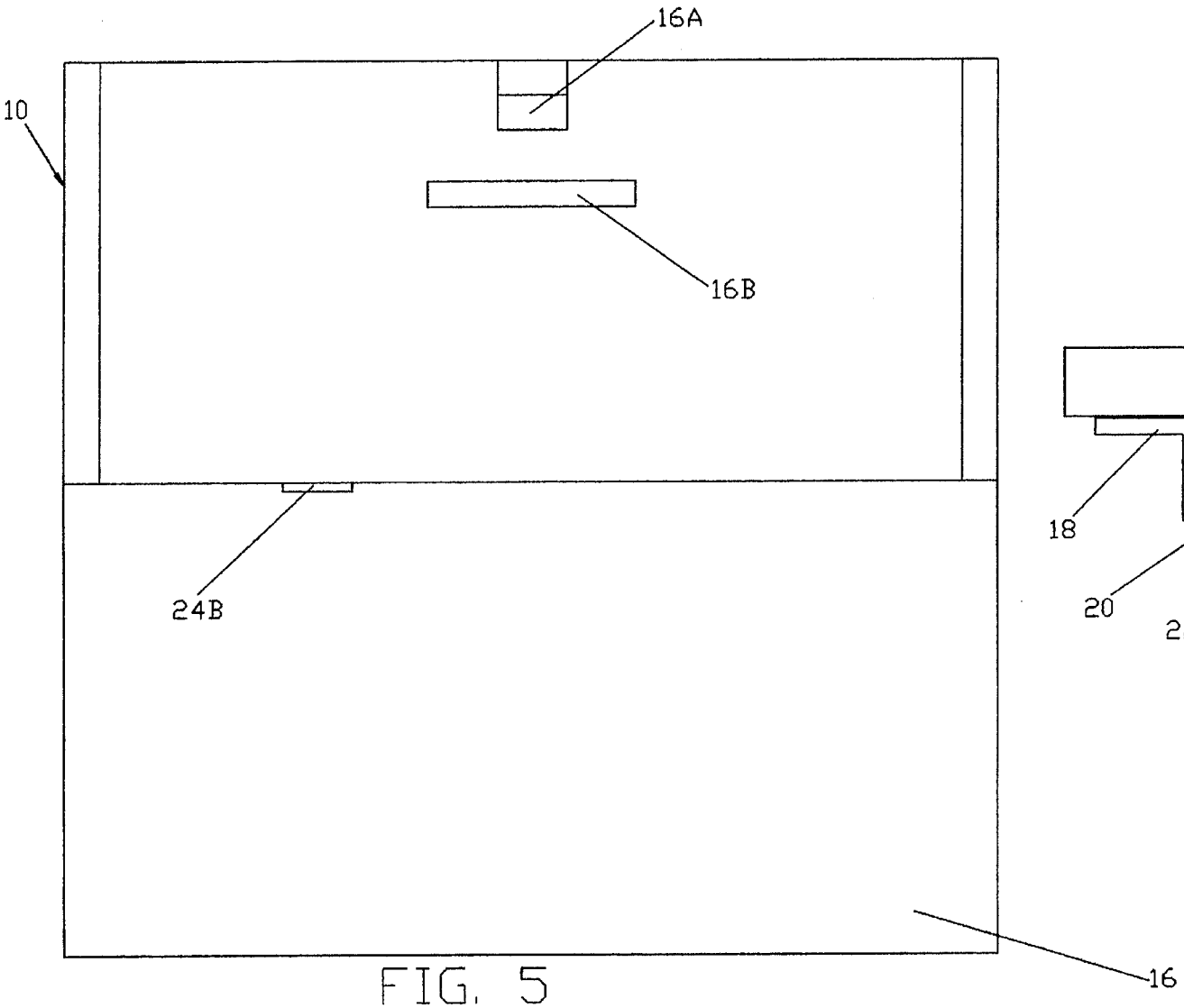
FIG. 5 is a bottom view of the lid.

Referring to FIG. 5 which is a bottom view of the lid 16 exhibiting the lid lock 16A and the lid clip 16B.

Figure 6:
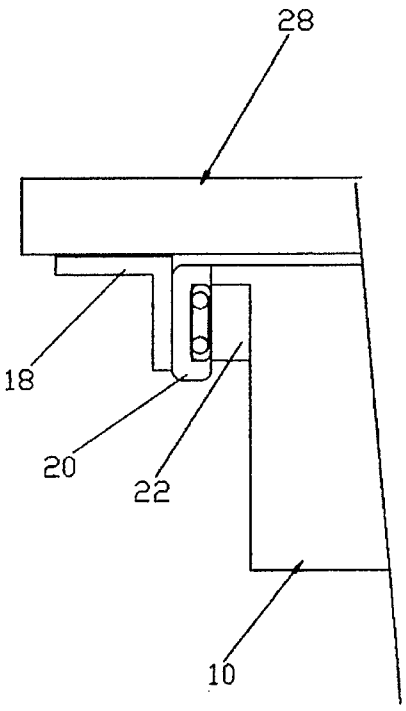
FIG. 6 is a front view of the glider assembly.

Referring to FIG. 6 which is a front view of the glide assembly exhibiting the glides 20, frame 22, and bracket 18 with the portable desk drawer 10 mounted thereon.

Referring to FIG. 7 which is a bottom view of the lid 16 exhibiting the lid lock 16A on the front of the lid 16. Two lid hinges 16C located in the middle of the lid 16 enable the front half of the lid 16 to be retracted upwardly thereby exposing the contents underneath. Two lid tabs 16D extend downwardly from the lid 16, and prevent the lid 16 from escaping the portable desk drawer 10 when the lid 16 is being slid backwardly.

Referring to FIG. 7B which is a side view of the lid 16 exhibiting the lid lock 16A and the lid hinges 16C.

Referring to FIG. 7C which is a front view of the lid 16 exhibiting the lid lock 16A and the lid hinges 16C, and the lid tabs 16C.

It will be understood that each of the elements described above, or two or more together, may also find a useful application in other types of constructions differing from the type described above.

While the invention has been illustrated and described as embodied in a portable desk drawer, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A portable desk drawer comprising:

a) a handle pivotally attached to a front of the portable desk drawer, the portable desk drawer further comprises a drawer insert which is preferably a plurality of drawer inserts, the plurality of drawer inserts forming a drawer insert compartment, the drawer insert compartment is preferably a plurality of drawer insert compartments situated in a back portion of the portable desk drawer, the portable desk drawer is further comprised of a front compartment located in the front of said portable desk drawer, a lid covering a top of the portable desk drawer, the lid further having a lid lock secured on a front of the lid and a lid clip attached to a middle of said lid;

b) a tray slidably housed underneath the lid, the tray is compromised of tray compartments, the tray further having a tray lid retractably affixed to a top of the tray, the tray further having tray glides attached under the tray and a tray stop extending downwardly from a bottom of the tray; and c) a frame extending outwardly from the top of the portable desk drawer, the frame being slidably housed in between glides on either side of the portable desk drawer, the glides are each attached to a bracket, the bracket further being mounted to a desk.

2. The portable desk drawer as described in claim 1, wherein the portable desk drawer is manufactured from the group of materials consisting of wood, metal, metal alloy, plastic, plastic composite, fiberglass and epoxy.

3. The portable desk drawer a described in claim 2, wherein the portable desk drawer is manufactured in different lengths and widths.

4. The portable desk drawer as described in claim 3, wherein the portable desk drawer is constructed to be used in conjunction with existing drawer glides.

5. The portable desk drawer as described in claim 1, wherein the brackets are mounted to the group consisting of desk, chair, cabinet, shelf, work bench, bookcase, counter, stand and table.

6. The portable desk drawer as described in claim 1, wherein the plurality of drawer inserts extend upwardly from the back portion of the portable desk drawer.

7. The portable desk drawer as described in claim 6, wherein the plurality of drawer inserts are spaced at varying lengths from one another.

8. The portable desk drawer as described in claim 7, wherein the plurality of drawer insert compartments have a variety of sizes.

9. The portable desk drawer as described in claim 1, wherein the tray is retracted to the rear of the portable desk drawer to cover the plurality of drawer insert compartments.

10. The portable desk drawer as described in claim 9, wherein the tray is secured over the plurality of drawer insert compartments by means of a tray stop.

11. The portable desk drawer as described in claim 1, wherein the lid is secured over the top of the portable desk drawer by means of a lid lock.

12. The portable desk drawer as described in claim 11, wherein the lid clip is exposed when the lid is open.

13. The portable desk drawer as described in claim 12, wherein the lid clip is adapted for securing paper, pads, charts, and documents.

14. The portable desk drawer as described in claim 1, wherein the portable desk drawer is removed from the glides and carried by means of the handle.

15. The portable desk drawer as described in claim 1, wherein the contents of the plurality of drawer insert compartments and the front compartment are prevented from escaping by means of the tray lid and lid, respectively, when the portable desk drawer is being carried.

16. The portable desk drawer as described in claim 1, wherein the top of the portable desk drawer has a lid slidably contained thereon, the lid is comprised of lid tabs which prevent the lid from escaping the portable desk drawer when the lid is slid backwardly, the lid further has a lid lock to secure the lid when the portable desk drawer is carried, lid hinges located on the lid enable a front portion of the lid to be retracted upwardly.

* * * * *